US010619616B2

(12) United States Patent
Oono et al.

(10) Patent No.: US 10,619,616 B2
(45) Date of Patent: Apr. 14, 2020

(54) IGNITION APPARATUS FOR INTERNAL COMBUSTION ENGINE

(71) Applicant: DENSO CORPORATION, Kariya, Aichi-pref. (JP)

(72) Inventors: Takashi Oono, Kariya (JP); Shunichi Takeda, Kariya (JP); Kanechiyo Terada, Kariya (JP); Yuuto Tamei, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/301,795

(22) PCT Filed: Apr. 10, 2015

(86) PCT No.: PCT/JP2015/061191
§ 371 (c)(1),
(2) Date: Oct. 4, 2016

(87) PCT Pub. No.: WO2015/156382
PCT Pub. Date: Oct. 15, 2015

(65) Prior Publication Data

US 2017/0114767 A1 Apr. 27, 2017

(30) Foreign Application Priority Data

Apr. 10, 2014 (JP) ..... 2014-081036

(51) Int. Cl.

| | |
|---|---|
| ***F02P 11/00*** | (2006.01) |
| ***F02P 3/08*** | (2006.01) |
| ***F02P 15/10*** | (2006.01) |
| *F02P 3/04* | (2006.01) |
| *F02P 9/00* | (2006.01) |
| *F02P 15/08* | (2006.01) |
| *F02P 3/05* | (2006.01) |

(52) U.S. Cl.
CPC ..... *F02P 3/0807* (2013.01); *F02P 3/0892* (2013.01); *F02P 11/00* (2013.01); *F02P 15/10* (2013.01);
(Continued)

(58) Field of Classification Search
CPC .. F02P 9/002; F02P 3/0876; F02P 3/05; F02P 15/08; F02P 15/10; F02P 3/0807;
(Continued)

(56) References Cited

U.S. PATENT DOCUMENTS 4,331,921 A * 5/1982 Walker ..... F02P 11/06 324/380
5,057,986 A * 10/1991 Henze ..... H02M 3/33576 363/20
(Continued)

FOREIGN PATENT DOCUMENTS

JP 2000-303940 10/2000
JP 2001-32758 2/2001
(Continued)

*Primary Examiner* — Mahmoud Gimie
*Assistant Examiner* — Joshua Campbell
(74) *Attorney, Agent, or Firm* — Nixon & Vanderhye P.C.

(57) ABSTRACT

A maximum value of a discharge current from a capacitor 13, detected by a primary-side current detection means 24 disposed at a grounded end of the capacitor 13, is controlled such as not to exceed a predetermined first control value Y1. The first control value Y1 is derived based on magnetic saturation of a primary winding 3, with the control being performed by controlling the on-off state of an energy injection switching means 20. As a result, magnetic saturation of the primary winding 3 can be prevented, and the reliability of an ignition apparatus which incorporates an energy injection circuit 6 can be increased.

16 Claims, 3 Drawing Sheets

(52) U.S. Cl.
CPC . *F02P 3/04* (2013.01); *F02P 3/05* (2013.01); *F02P 3/0876* (2013.01); *F02P 9/002* (2013.01); *F02P 9/007* (2013.01); *F02P 15/08* (2013.01)

(58) Field of Classification Search
CPC .. F02P 3/0892; F02P 3/04; F02P 11/00; F02P 9/007
USPC ..... 123/628, 634, 636
See application file for complete search history.

(56) References Cited

U.S. PATENT DOCUMENTS

| | | | | | |
|---|---|---|---|---|---|
| 5,060,623 | A * | 10/1991 | McCoy | F02P 3/0884 | 123/605 |
| 2007/0181110 | A1 | 8/2007 | Toriyama et al. | | |
| 2007/0194722 | A1 * | 8/2007 | Bruekers | H02J 9/02 | 315/291 |
| 2008/0127937 | A1 | 6/2008 | Toriyama et al. | | |
| 2011/0127936 | A1 * | 6/2011 | Ogasawara | H02M 3/158 | 318/400.3 |
| 2012/0085327 | A1 | 4/2012 | Mizukami et al. | | |

FOREIGN PATENT DOCUMENTS

| | | | | |
|---|---|---|---|---|
| JP | 2002180941 | A * | 6/2002 | |
| JP | 2003-028037 | | 1/2003 | |
| JP | 2003028037 | A * | 1/2003 | |
| JP | 2009-221850 | | 10/2009 | |
| JP | 2009-228507 | | 10/2009 | |
| JP | 2009293474 | A * | 12/2009 | F02P 3/0892 |
| JP | 2015-200300 | | 11/2015 | |

* cited by examiner

IGNITION APPARATUS FOR INTERNAL COMBUSTION ENGINE

CROSS-REFERENCE TO RELATED APPLICATION

This application is the U.S. national phase of International Application No. PCT/JP2015/061191 filed on Apr. 10, 2015 which designated the U.S. and claims the benefit of priority from earlier Japanese Patent Application No. 2014-081036 filed on Apr. 10, 2014 the entire contents of each of which are incorporated herein by reference.

FIELD

The present invention relates to an ignition apparatus for an internal combustion engine, and in particular to spark discharge continuation technology.

BACKGROUND

Technology is known which can be used for adding, to a usual ignition apparatus (main ignition apparatus), an apparatus for continuing a spark discharge after the discharge has been initiated by a main ignition apparatus. The continuation is achieved by supplying discharge energy into the ignition coil after the discharge has been initiated. It is intended to attain stable ignition in that way, by extending the continuation time of the discharge after commencement.

CITATION LIST

Patent Literature

[PTL 1] JP-B-4613848

SUMMARY

Technology (not public knowledge) has been envisaged for reducing the load on spark plugs and preventing waste of energy, for the continuation of spark discharge. This technology uses an "energy injection circuit" which causes a known type of ignition circuit (referred to as the main ignition circuit) to initiate a spark discharge (referred to as the main ignition) and, before the main ignition has become quenched, supplies electrical energy from the negative end of the primary winding towards a battery power supply line, causing current (DC secondary current) to flow in a secondary winding in the same direction, thereby causing the spark discharge generated by the main ignition to continue for an arbitrary duration (referred to in the following as an electric discharge continuation interval).

In the following, a spark discharge that is continued by means of the energy injection circuit (i.e., a spark discharge which follows main ignition) is referred to as a "continuation spark discharge".

For ease of understanding, a representative example of a novel ignition apparatus which uses the energy injection circuit will be described based on FIG. 5. The designations used in FIG. 5 are identical to those used with embodiments described hereinafter, in referring to the same functional items as in FIG. 5.

An ignition apparatus shown in FIG. 5 is a combination of a main ignition circuit 5 and an energy injection circuit 6. The main ignition circuit 5 generates the main ignition in a spark plug 1 by fully transistorized. The energy injection circuit 6 includes:

a step-up circuit 12 which steps up the battery voltage;

a capacitor 13 which stores electrical energy that has been stepped-up in voltage by the step-up circuit 12; and energy injection control means 14 which controls the injection of electrical energy from the capacitor 13 into a primary winding 3 of an ignition coil 2, thereby controlling the secondary current.

An example of the energy injection control means 14 includes:

energy injection switching means 20 which connects and disconnects an energy injection line β, through which electrical energy is supplied from the capacitor 13 into the primary winding 3, an energy injection drive circuit 21 which switches on/off the energy injection switching means 20, and a control circuit 22 which holds the secondary current at a predetermined target value, by controlling the on/off condition of the energy injection switching means 20 via the energy injection drive circuit 21.

While the energy injection circuit 6 is in operation (specifically, while a discharge continuation signal IGw is in the on state):

(i) if the secondary current, which is monitored by a secondary current detection resistor 23, falls below the target value, the control circuit 22 turns on the energy injection switching means 20, thereby supplying part of the electrical energy charged in the capacitor 13 into the primary winding 3;

(ii) if the secondary current rises above the target value, the control circuit 22 executes control for turning off the energy injection switching means 20, thereby interrupting the injection of electrical energy into the primary winding 3.

The inventors of the present invention have found the following problem.

(Problem)

During operation of the energy injection circuit 6, when the spark discharge is caused to waver by strong air currents, etc., within the engine cylinder, the spark discharge length is increased to extend the duration of the condition of decreasing the secondary current. In this case, the duration of the on state of the energy injection switching means 20 is increased, due to feedback control of the secondary current.

If the on-state duration of the energy injection switching means 20 is increased, the primary current is increased at the time of energy injection, and hence the primary winding 3 can reach a state of magnetic saturation.

If the primary winding 3 reaches magnetic saturation, the effect of increasing the secondary current will be reduced, so that the feedback control will operate such as to increase the energy that is supplied into the primary winding 3. As a result, the load imposed on the energy injection switching means 20 and the primary winding 3 becomes high, resulting in a danger of damaging these components, due to overheating or thermal runaway.

In view of the above problem, it is an objective of the present disclosure to provide an ignition apparatus for an internal combustion engine whereby magnetic saturation of a primary winding due to operation of an energy injection circuit can be prevented, so that problems caused to various components due to such magnetic saturation can be avoided.

With an internal combustion engine-use ignition apparatus according to a first aspect of the present disclosure, electrical energy that is supplied into a primary winding is controlled based on a capacitor discharge current that is detected by primary-side current detection means, thereby limiting a maximum value of the capacitor discharge current detected by the primary-side current detection means to be less than a predetermined first control value.

Problems due to magnetic saturation of the primary winding can thereby be avoided, by limiting the electrical energy supplied into the primary winding, on the basis of the value detected by the primary-side current detection means, so as to be within a predetermined value. As a result, damage to the primary winding due to heat or thermal runaway, or damage to part of the energy injection circuit (e.g., the energy injection switching means, etc.) can be avoided, so that the reliability of an ignition apparatus for an internal combustion engine can be increased.

With an ignition apparatus for an internal combustion engine according to a second aspect of the present disclosure, when the capacitor discharge current detected by the primary-side current detection means attains a specific second control value Y2, the injection of energy into the primary winding is halted.

By halting the injection of energy, on the basis of the detection value obtained by the primary-side current detection means, into the primary winding before magnetic saturation of the primary winding occurs, trouble due to the magnetic saturation can be avoided. Hence, damage to the primary winding due to heat or thermal runaway, or damage to part of the energy injection circuit (e.g., the energy injection switching means, etc.) can be prevented, so that the reliability of an ignition apparatus for an internal combustion engine can be increased.

DESCRIPTION OF THE EMBODIMENTS

Embodiments for carrying out the invention are specifically described in the following.

[Embodiments]

Specific embodiments will be described based on the drawings. These embodiments disclose only specific examples, and the invention should, of course, not be limited to these examples.

(First Embodiment)

Figure 1:
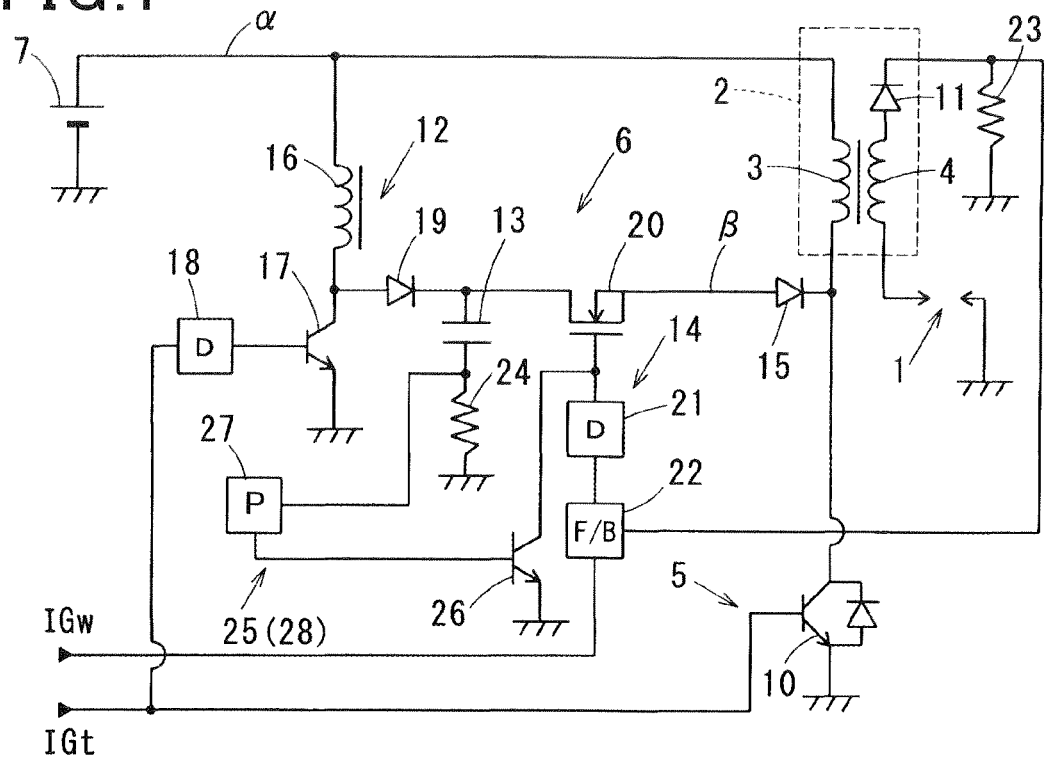
FIG. 1 is a general configuration diagram of an ignition apparatus for an internal combustion engine (first and second embodiments).

A first embodiment will be described referring to FIGS. 1 and 2.

An ignition apparatus of the first embodiment is used in an internal combustion engine which drives a vehicle, and performs ignition of gas mixtures within combustion chambers at specific timings. The engine example of this embodiment is a direct injection engine which uses gasoline as fuel and is capable of lean-burn combustion. Such an engine incorporates an EGR (exhaust gas regeneration) apparatus which returns a part of the exhaust gas, as EGR gas, to the engine air intake. Furthermore, the engine includes rotational flow control means which generates rotational flow (tumble flow, swirl flow, etc.) of the air/fuel mixture within each cylinder.

The ignition apparatus of the first embodiment is a DI (abbreviation for "direct-ignition") type which use ignition coils 2 corresponding to spark plugs 1 of the respective cylinders of the engine.

With this ignition apparatus, conduction control of a primary winding 3 of each ignition coil 2 is performed based on command signals (an ignition signal IGt and a discharge continuation signal IGw) which are produced from an ECU (engine control unit) on which engine control is centered. The ignition apparatus controls the electrical energy produced by the secondary winding 4 of the ignition coil 2, by means of conduction control of the primary winding 3, thereby controlling the spark discharge of the spark plug 1.

The ECU generates and outputs the ignition signal IGt and discharge continuation signal IGw in accordance with engine parameters (warm-up condition, engine rotation speed, engine load, etc.) and engine control status (whether or not lean-burn combustion being applied, degree of rotational flow, etc.).

The ignition apparatus installed in the vehicle includes:

the spark plugs 1 installed in respective cylinders, the ignition coils 2 installed for respective spark plugs 1, a main ignition circuit 5 which performs full-transistor ignition operation, and an energy injection circuit 6 which executes spark discharge continuation.

The main parts of the main ignition circuit 5 and energy injection circuit 6 are contained together within a case, as an ignition circuit unit, and are installed at a different location from the spark plugs 1 and the ignition coils 2.

The spark plugs 1 are of well-known type, each having a central electrode which is connected to one end of the secondary winding 4, and an outer electrode which is connected to ground via the engine cylinder head, etc. The spark plugs 1 each generate a spark discharge between the central electrode and the outer electrode by means of a high voltage applied from the secondary winding 4.

The ignition coil 2 is of well-known type, having the primary winding 3 and the secondary winding 4, with the secondary winding 4 having many more winding turns than the primary winding 3. One end of the primary winding 3 is connected to a battery voltage supply line $\alpha$, which receives electric power from the positive terminal of a vehicle-installed battery 7.

The other end of the primary winding 3 is connected to ground via an ignition switching means 10 of the main ignition circuit 5 (e.g., a power transistor, MOS type transistor, thyristor, etc.).

One end of the secondary winding 4 is connected to the central electrode of the spark plug 1 as described above.

The other end of the secondary winding 4 is connected to ground, or is connected to the battery voltage supply line $\alpha$. With the example of FIG. 1, the other end of the secondary winding 4 is connected to ground via a first diode 11 which suppresses secondary voltages that are produced when current is passed through the primary winding 3, and a secondary current detection resistor 23 (described hereinafter).

The main ignition circuit 5 generates the main ignition in the spark plug 1 by controlling current passing through the primary winding 3. Specifically, the main ignition circuit 5 turns on the ignition switching means 10 during an interval in which the ignition signal IGt is on. Hence, when the ignition switching means 10 is turned on, current is passed through the primary winding 3 of the ignition coil 2.

The energy injection circuit 6 supplies electrical energy from the negative terminal of the primary winding 3 to the battery voltage supply line α, during the main ignition that is produced by the operation of the main ignition circuit 5. The energy injection circuit 6 thereby continues the passing of secondary current through the secondary winding 4, in the same direction as during the main ignition, and so continues the spark discharge produced by the operation of the main ignition circuit 5.

Specifically, during a driving condition in which the ignitability is low (during lean-combustion operation, or while strong rotational air currents are produced, or when a high EGR is utilized, or when the engine is being started in a low-temperature condition, etc.), the energy injection circuit 6 continues spark discharge to thereby increase the ignitability of the air/fuel mixture. The energy injection circuit 6 includes:

a step-up circuit 12 which steps up the battery voltage, a capacitor 13 which stores the electrical energy that has been stepped-up in voltage by the step-up circuit 12, energy injection control means 14 which controls the injection of electrical energy into the primary winding 3 from the capacitor 13, thereby controlling the secondary current, and a second diode 15 which passes current in a direction only from the capacitor 13 to the primary winding 3.

The step-up circuit 12 is a chopper type of DC-DC converter which performs DC voltage step-up, and which includes:

a choke coil 16 having one end connected to the battery voltage supply line α, a step-up switching means 17 which connects and disconnects a current path of the choke coil 16 (e.g., a field effect transistor, a power transistor, etc.), a step-up drive circuit 18 which performs repetitive on/off switching of the step-up switching means 17, and a third diode 19 which prevents electrical energy stored in the capacitor 13 from flowing back to the choke coil 16.

The step-up drive circuit 18 cyclically turns on/off the step-up switching means 17, during each interval that is determined by the ignition signal IGt from the ECU.

An example of the energy injection control means 14 includes an energy injection switching means 20, an energy injection drive circuit 21 and a control circuit 22.

The energy injection switching means 20 connects and disconnects an energy injection line β, through which electrical energy is supplied from the capacitor 13 to the primary winding 3, and is configured of a MOS transistor, a power transistor, etc., for example.

The energy injection drive circuit 21 switches on/off the energy injection switching means 20.

The control circuit 22 controls the on/off condition of the energy injection switching means 20 via the energy injection drive circuit 21, to thereby control the secondary current to a predetermined target value. For example, the control circuit 22 modulates the on/off duty ratio of the energy injection switching means 20, to thereby control the secondary current to a predetermined target value.

The control circuit 22 performs feedback control of the on/off condition of the energy injection switching means 20 via the energy injection drive circuit 21, so that the control secondary current value, which is monitored using the secondary current detection resistor 23, is maintained at a predetermined target value.

The control circuit 22 is not limited to the use of feedback control. It would be equally possible to use open-loop control, as on/off control, for the energy injection switching means 20, to hold the secondary current within a predetermined target range of values. Furthermore, the target value of the secondary current during continuation of the spark discharge may be a fixed value, or may be varied in accordance with the running condition of the engine (as expressed by command signals from the ECU, not shown).

(Description of Operation of Ignition Apparatus)

The basic operation of the main ignition circuit 5 and the energy injection circuit 6 will be described.

When the ignition signal IGt is changed from off to on:

(a) the ignition switching means 10 is turned on throughout the interval in which the ignition signal IGt is outputted;

(b) at the same time, the step-up switching means 17 is repetitively turned on/off, to perform voltage step-up operation, throughout the interval in which the ignition signal IGt is outputted, and electrical energy at the stepped-up voltage, which is higher than the battery voltage, is stored in the capacitor 13;

(c) when the ignition signal IGt is changed from on to off, the ignition switching means 10 is turned off, and the condition of passing current through the primary winding 3 is suddenly interrupted. As a result, the flow of primary current is halted, and concurrently the primary voltage rises. The secondary voltage thereby rises, so that a high voltage is applied to the spark plug 1, and the main ignition is generated in the spark plug 1;

(d) after the main ignition has been initiated in the spark plug 1, the secondary current attenuates, with a substantially triangular waveform. Before the secondary current has decreased to a predetermined limit current value (the value of current required for maintaining the spark discharge), the ECU outputs the discharge continuation signal IGw.

Then, the control circuit 22 performs on/off control of the energy injection switching means 20, so that the electrical energy (electrical charge) stored in the capacitor 13 is supplied into the negative end of the primary winding 3. That is, the electrical energy stored in the capacitor 13, which is at a higher voltage than the battery voltage, flows from the negative end of the primary winding 3 to the battery voltage supply line α.

Specifically, each time the energy injection switching means 20 is turned on, electrical energy is supplementarily supplied from the negative end of the primary winding 3 to the battery voltage supply line α. Each time this occurs, a secondary current supplementarily flows in the secondary winding 4, passing in the same direction as the secondary current which flows through the secondary winding 4 at the main ignition. As a result, such supplemental flows of secondary current through the secondary winding 4 occur successively, following the main ignition.

Thus, by performing on/off control of the energy injection switching means 20, the control circuit 22 maintains the secondary current to a degree which enables the spark discharge to be continued.

In that way, by maintaining a continuation spark discharge during the interval for which the discharge continuation signal IGw is continued, a high degree of ignitability can be achieved. Furthermore, while the continuation spark discharge is being maintained, the secondary current is controlled to be held substantially constant, so that there can be a reduced extent of electrode wear that is caused by high currents. In addition, while the continuation spark discharge is being maintained, since the secondary current is held substantially constant, wasteful power consumption can be prevented, thereby providing an enhanced energy-saving effect.

(f) When the discharge continuation signal IGw is changed from on to off, the energy injection switching means 20 is switched off. As a result, operation of the energy injection circuit 6 is halted, and the continuation spark discharge is terminated.

(Special Technology of the First Embodiment)

While the energy injection circuit 6 is in operation, the spark discharge that is generated in the spark plug 1 may be caused to waver due to strong air currents produced within the engine cylinder, and the length of the spark discharge may be increased to thereby decrease the secondary current. However, in that case, the duration of the on state of the energy injection switching means 20 is increased as a result of the feedback control of the secondary current, thereby increasing the electrical energy supplied into the primary winding 3.

However, if the duration of the on state of the energy injection switching means 20 is increased, there is a danger that the primary current is increased to thereby produce magnetic saturation of the primary winding 3. If magnetic saturation of the primary winding 3 occurs, the extent of increase of the secondary current will be less than the envisaged extent. In that case, since the electrical energy injection is continued as a result of the feedback control, the magnetic saturation of the primary winding 3 will suddenly increase. When this occurs and the primary current suddenly increases accordingly, the effect of increasing the secondary current will become decreased, so that energy will be wastefully consumed. In addition, there is a danger that circuits or windings may be damaged. The chain line A' in FIG. 2 illustrates an example of current which would produce magnetic saturation of the primary winding 3, if the present invention were not applied.

Figure 2:
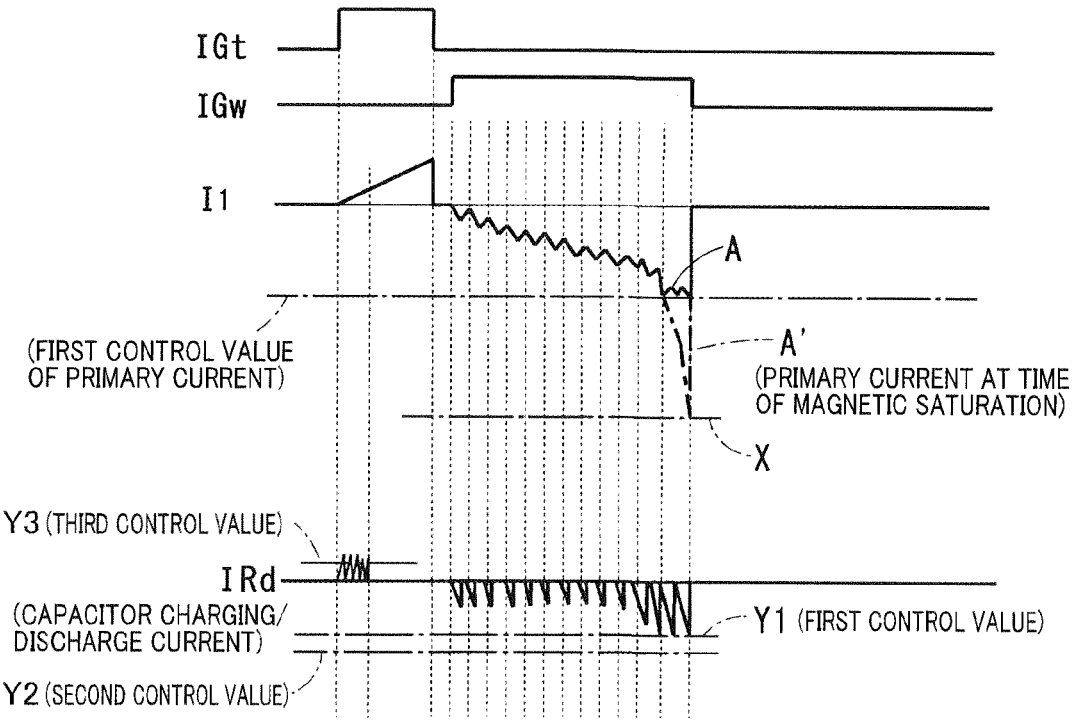
FIG. 2 is a timing diagram for description of operation (first to third embodiments).

In FIG. 2, "IGt" is the high/low signal of the ignition signal IGt, "IGw" is the high/low signal of the discharge continuation signal IGw, "I1." is the primary current (current which flows in the primary winding 3), and "IRd" is the charging/discharge current of the capacitor 13. In the graph in FIG. 2, the horizontal axes of "I1." and "IRd" correspond to zero, and when magnitude of the capacitor charging/discharge current or the momentary current is mentioned, it means the magnitude of an absolute value.

The ignition apparatus of the first embodiment includes, as means for preventing magnetic saturation of the primary winding 3:

a primary-side current detection means 24, which detects the capacitor discharge current that is supplied from the capacitor 13 to the primary winding 3; and a first protection means 25 which prevents magnetic saturation of the primary winding 3 and prevents wasteful power consumption and heat generation, by controlling the condition of supplying electrical energy into the primary winding 3 from the capacitor 13.

The primary-side current detection means 24 serves as a current detection resistor which is provided at the ground connection side of the capacitor 13. The charging/discharge current of the capacitor 13 (the capacitor charging current that flows at the positive end and the capacitor discharge current that flows at the negative end) is detected by this current detection resistor.

The first protection means 25 controls the electrical energy that is supplied into the primary winding 3 from the capacitor 13, based on the capacitor discharge current detected by the primary-side current detection means 24, and controls the maximum value of the capacitor discharge current as detected by the primary-side current detection means 24 to be less than a predetermined first control value.

That is, the energy injection switching means 20 is directly or indirectly controlled such as to prevent the maximum value of capacitor discharge current, which is detected by the primary-side current detection means 24, from exceeding the first control value Y1. Correlation of the discharge current with the primary current when the capacitor discharge current is at the first control value Y1 is determined beforehand by testing, etc. For example, as a result of the testing, that value of primary current is set to approximately a range of 50 to 90% of the saturation current value X.

The first protection means 25 includes:

an off switching means 26 (a bipolar transistor, field effect transistor, etc.) for forcibly turning off the energy injection switching means 20; and a protection circuit 27 which controls the capacitor discharge current, which is detected by the primary-side current detection means 24, such as not to exceed the first control value Y1, by performing on/off control of the off switching means 26.

(Advantageous Effects 1 of the First Embodiment)

During operation of the energy injection circuit 6 (that is, while the discharge continuation signal IGw is in the on state), when a capacitor discharge current IRd, which is detected by the primary-side current detection means 24, reaches the first control value Y1, the protection circuit 27 turns on the off switching means 26, and forcibly turns off the energy injection switching means 20, irrespective of the control status of the control circuit 22. Next, when the capacitor discharge current IRd, which is detected by the primary-side current detection means 24, again becomes less than the first control value Y1, the protection circuit 27 turns off the off switching means 26, and the energy injection switching means 20 is controlled by the control circuit 22.

As a result of the operation of the first protection means 25, as shown by the full-line A in FIG. 2, the maximum (absolute) value of the primary current I1 is limited to less than the saturation current value X, based on the capacitor discharge current IRd detected by the primary-side current detection means 24.

In that way, problems caused by magnetic saturation of the primary winding 3 due to operation of the energy injection circuit 6 can be prevented. Specifically, damage to the energy injection switching means 20 or the primary winding 3 due to thermal runaway or heating, caused by magnetic saturation of the primary winding 3, can be prevented. The reliability of an ignition apparatus which incorporates the energy injection circuit 6 can thereby be enhanced.

(Advantageous Effects 2 of the First Embodiment)

The primary-side current detection means 24 of the first embodiment serves as a current detection resistor which is connected to the grounded terminal of the capacitor 13. Since the current load at the grounded terminal of the capacitor 13 is small, the current detection resistor can be downsized. Hence, the energy injection circuit 6 is prevented from becoming large in size, and accordingly, the ignition circuit unit can be downsized and cost increase of the ignition apparatus can be avoided.

(Alternative Forms of the First Embodiment)

The first embodiment has been described by way of an example in which the energy injection control means 14 may be independent of the first protection means 25. However, it would be equally possible for the energy injection control means 14 to be integrated with the first protection means 25. That is, the off switching means 26 could be discarded, and the energy injection switching means 20 may be controlled directly for preventing magnetic saturation of the primary winding 3.

(Second Embodiment)

A second embodiment will be described, referring to FIGS. 1 and 2. The second embodiment has basically the same configuration as for the first embodiment, so that the same diagrams are used for describing the second embodiment as for the first embodiment. With each of the following embodiments, items which correspond to items in the first embodiment are referred to by the same designations as for the first embodiment.

With the first embodiment, the energy injection switching means 20 is controlled such as to prevent magnetic saturation of the primary winding 3.

However, with the second embodiment, when the primary current approaches the magnetic saturation current value X, the injection of electrical energy into the primary winding 3 is halted, to prevent magnetic saturation of the primary winding 3.

With the second embodiment, the means for preventing magnetic saturation of the primary winding 3 includes:

the primary-side current detection means 24 similar to the first embodiment; and a second protection means 28, which disconnects the energy injection line β when the primary current approaches the magnetic saturation current value X, and thereby prevents magnetic saturation of the primary winding 3.

When the capacitor discharge current IRd, which is detected by the primary-side current detection means 24, reaches a predetermined second control value Y2, the second protection means 28 halts the injection of electrical energy from the capacitor 13 into the primary winding 3.

That is to say, with the second embodiment, the energy injection line β is disconnected when the capacitor discharge current detected by the primary-side current detection means 24 reaches the second control value Y2. Correlation of the capacitor discharge current with the primary current when it is at the second control value Y2 is determined beforehand by testing, etc. From the results obtained from the testing, for example, the value of the primary current is set to approximately a range of 60 to 100% of the saturation current value X.

The second protection means 28 having basically the same configuration as the first protection means 25 of the first embodiment includes:

the off switching means 26 for forcibly turning off the energy injection switching means 20; and the protection circuit 27, which turns on the off switching means 26 to forcibly turn off the energy injection switching means 20, when the capacitor discharge current, which is detected by the primary-side current detection means 24, reaches the second control value Y2.

(Advantageous Effects of the Second Embodiment)

During operation of the energy injection circuit 6 (that is, while the discharge continuation signal IGw is turned on), when the capacitor discharge current, which is detected by the primary-side current detection means 24, has reached the second control value Y2, the protection circuit 27 turns on the off switching means 26 to forcibly switch off the energy injection switching means 20. As a result, the injection of electrical energy into the primary winding 3 is halted, so that problems caused by magnetic saturation of the primary winding 3 are avoided.

In that way, problems due to magnetic saturation of the primary winding 3 can be prevented. Specifically, similar to the first embodiment, damage to the energy injection switching means 20 or the primary winding 3 due to thermal runaway or heating, caused by magnetic saturation of the primary winding 3, can be prevented, thereby enhancing the reliability of an ignition apparatus which incorporates the energy injection circuit 6.

(Alternative Forms of the Second Embodiment)

The second embodiment has been described by way of an example in which the energy injection control means 14 is independent of the second protection means 28. However, it would be equally possible for the energy injection control means 14 to be integrated with the second protection means 28. That is, the off switching means 26 could be discarded, and magnetic saturation of the primary winding 3 can be prevented by switching off the energy injection switching means 20.

With the second embodiment, the means for halting the injection of electrical energy serves to turn off the energy injection switching means 20. However, it would be equally possible to turn off an output halt switching means of a fourth embodiment, which will be described hereinafter. Furthermore, the first embodiment may be combined with the second embodiment.

(Third Embodiment)

Figure 3:
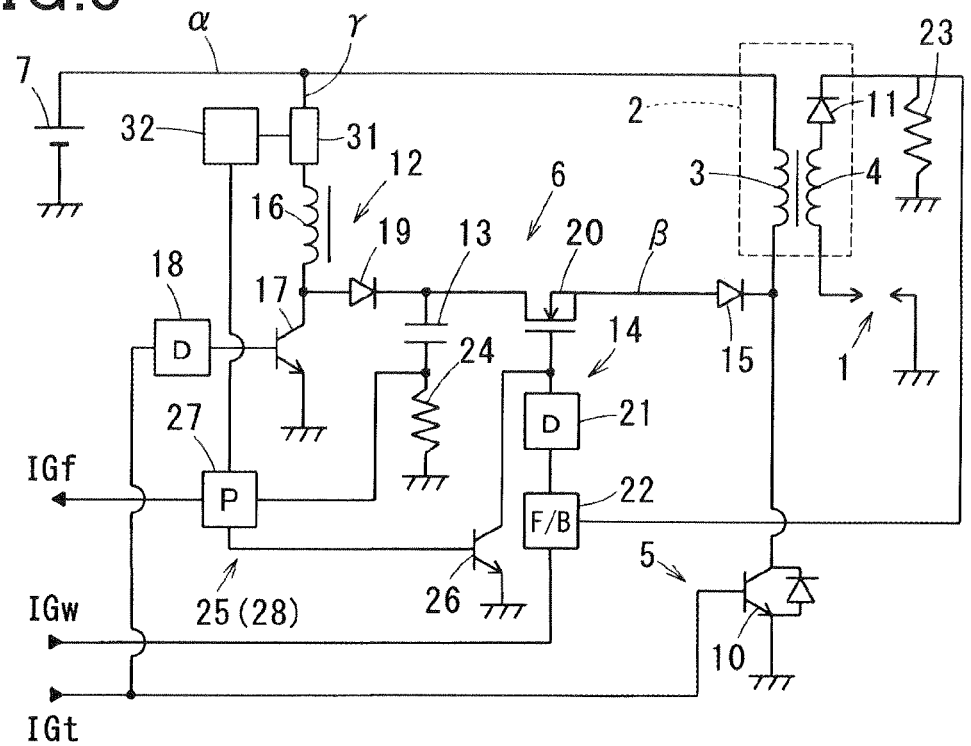
FIG. 3 is a general configuration diagram of an ignition apparatus for an internal combustion engine (third embodiment).

A third embodiment will be described referring to FIGS. 2 and 3.

The protection circuit 27 of the third embodiment judges the energy injection circuit 6 for failure, based on the capacitor charge current or capacitor discharge current that is detected using the primary-side current detection means 24. When failure is judged to occur, operation of the energy injection circuit 6 is halted and a failure judgement signal IGf is outputted to the ECU, to notify the ECU that failure has occurred.

Points concerning the third embodiment are:

(a) when failure is judged to occur, the step-up circuit 12 is disconnected from the electric power supply section;

(b) failure of the energy injection circuit 6 is judged based on the capacitor discharge current that is detected by the primary-side current detection means 24;

(c) failure of the energy injection circuit 6 is judged based on the capacitor charge current that is detected by the primary-side current detection means 24.

Specifically, with the third embodiment, the means for disconnecting the step-up circuit 12 from the electric power supply section when a failure is judged to occur includes:

an operation halt switching means 31 (e.g., a normally-on relay switch, or a semiconductor switch, etc.) which switches on/off a voltage step-up power source line 'γ which applies the battery voltage to the step-up circuit 12; and an operation halt drive circuit 32 which can change over the operation halt switching means 31 to the off state.

When a failure of the energy injection circuit 6 is detected, the protection circuit 27 acts, via the operation halt drive circuit 32, to switch off the operation halt switching means 31, thereby halting operation of the energy injection circuit 6.

Furthermore, when a failure of the energy injection circuit 6 is judged to occur, the protection circuit 27 outputs the failure judgement signal IGf, for notifying the ECU of the failure occurrence, concurrently with switching off the operation halt switching means 31.

On the other hand, when the ECU receives the failure judgement signal IGf from the protection circuit 27, it illuminates lamps, etc., to notify the vehicle driver of the failure occurrence, and halts the lean-burn operation of the engine. The ignitability is thereby increased while using only the main ignition circuit 5 for ignition, so that the vehicle is enabled to run in a limp-home mode.

The following description addresses the technology with which the protection circuit 27 judges failure of the energy injection circuit 6 based on the capacitor discharge current that is detected by the primary-side current detection means 24.

The protection circuit 27 judges that there is failure of the energy injection circuit 6 when one of the following conditions, or an arbitrary combination of a plurality of these conditions, occurs:

(i) the capacitor discharge current detected by the primary-side current detection means 24 reaches the second control value Y2;

(ii) the capacitor discharge current reaches the second control value Y2 for a predetermined number of times in succession;

(iii) the capacitor discharge current reaches the second control value Y2, and continues at that value for a predetermined duration.

When it is judged that there is failure, the protection circuit 27 switches off the operation halt switching means 31 and outputs the failure judgement signal IGf to the ECU, as described above.

The following description addresses the technology with which the protection circuit 27 judges failure of the energy injection circuit 6 based on the capacitor charge current that is detected by the primary-side current detection means 24.

The protection circuit 27 judges that there is failure of the energy injection circuit 6 when one of the following conditions, or an arbitrary combination of a plurality of these conditions, occurs:

(i) during voltage step-up operation of the step-up circuit 12 (during an interval in which the ignition signal IGt is outputted), the capacitor charge current does not reach a predetermined third control value Y3;

(ii) the capacitor charge current does not reach the third control value Y3 for a predetermined number of times in succession;

(iii) the capacitor charge current does not reach the third control value Y3, and continues that condition for a predetermined duration.

When it is judged that there is failure, the protection circuit 27 switches off the operation halt switching means 31 and outputs the failure judgement signal IGf to the ECU, as described above.

(Advantageous Effects of the Third Embodiment)

With the ignition apparatus of the third embodiment, as described above, failure judgement of the energy injection circuit 6 is performed based on the capacitor discharge current or capacitor charge current that is detected by the primary-side current detection means 24.

Specifically, the protection circuit 27 switches off the operation halt switching means 31 to halt operation of the energy injection circuit 6, if it is detected that the capacitor charge current or capacitor discharge current exceeds the second control value Y2, or has not reached the third control value Y3 value, such as when:

(a) there is a short-circuit failure of the energy injection switching means 20, (b) the discharge continuation signal IGw becomes fixed in the on state (Hi state), or (c) the step-up switching means 17 or the choke coil 16 of the step-up circuit 12 is operating abnormally due to an open-circuit or ground fault.

In that way, even in the event that a problem occurs with the energy injection circuit 6, the operation of the energy injection circuit 6 is halted, thereby preventing the danger that a failure of the energy injection circuit 6 will affect other equipment (the ECU, or fuel injection equipment, etc., which shares the same power source). Thus, the reliability of the ignition apparatus is thereby increased.

(Fourth Embodiment)

Figure 4:
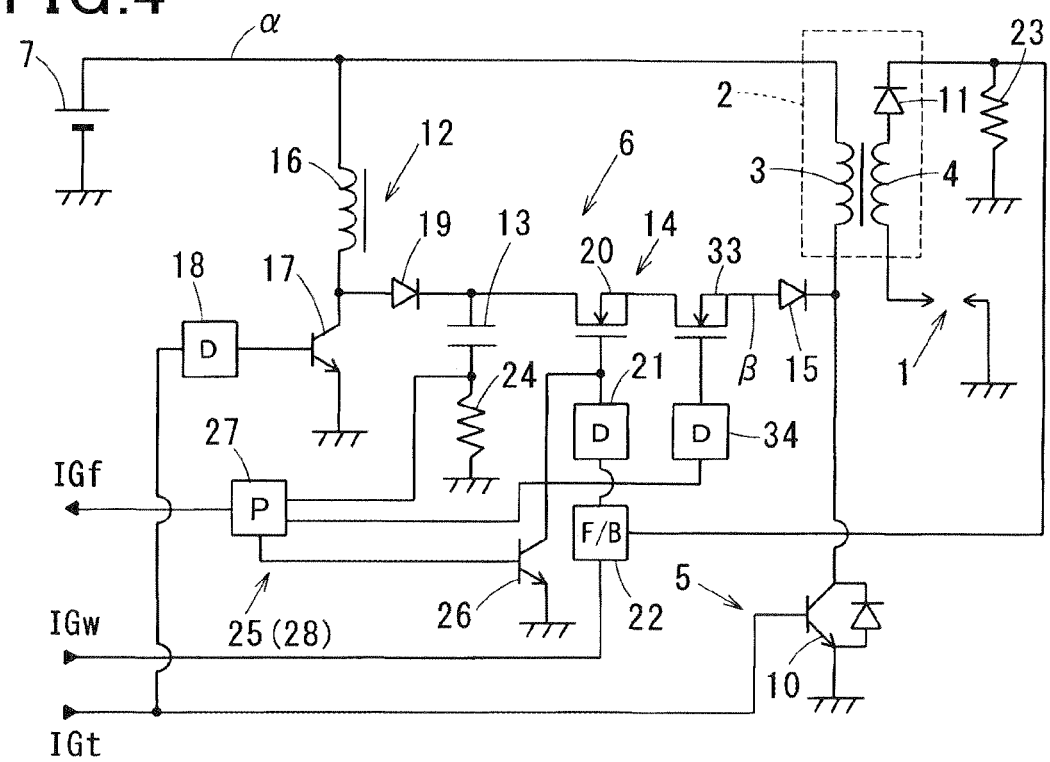
FIG. 4 is a general configuration diagram of an ignition apparatus for an internal combustion engine (fourth embodiment).
Figure 5:
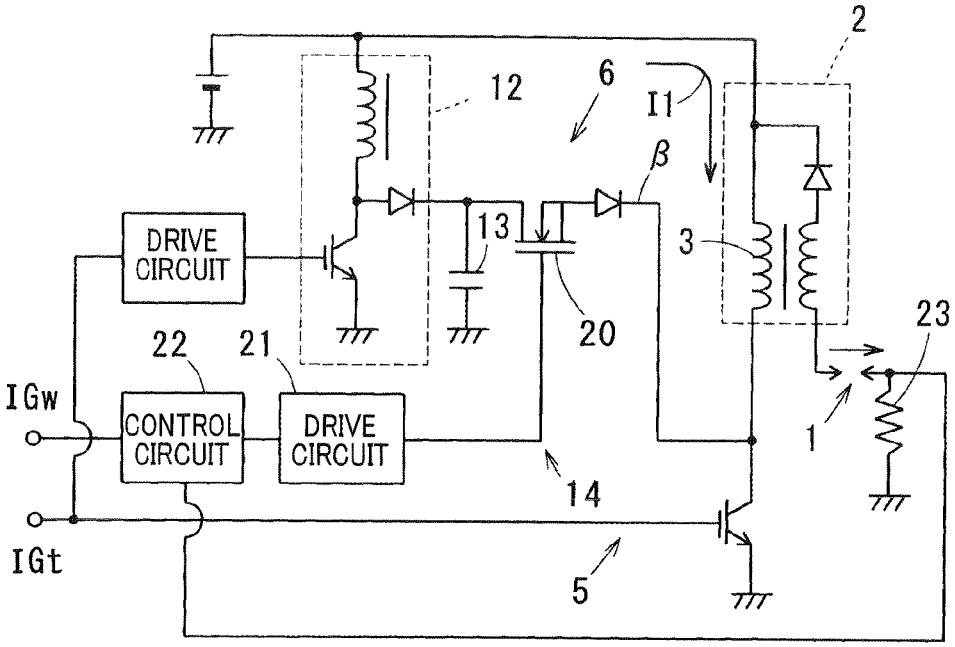
FIG. 5 is a general configuration diagram of an ignition apparatus for an internal combustion engine (reference example: technology not publicly known).

A fourth embodiment will be described referring to FIG. 4.

With the third embodiment described above, when a failure of the protection circuit 27 is judged to occur, the step-up power source line γ is disconnected, thereby halting the supply of electric power to the step-up circuit 12.

However, with the fourth embodiment, when a failure of the protection circuit 27 is judged to occur, the energy injection line β is opened, thereby halting the injection of electrical energy into the primary winding 3.

Specifically, the ignition apparatus of the fourth embodiment includes:

an output halt switch means 33 (e.g., a MOS type transistor, power transistor, normally-on relay switch, etc.) for turning on/off the energy injection line β between the energy injection switching means 20 and the primary winding 3; and an output halt drive circuit 34 which can switch off the output halt switch means 33.

The protection circuit 27:

(i) when a failure of the energy injection circuit 6 is judged to occur, switches off the output halt switch means 33, while outputting the failure judgement signal IGf to the ECU; and, (ii) when a failure of the step-up circuit 12 is judged to occur, outputs the failure judgement signal IGf to the ECU, while also halting operation of the step-up drive circuit 18, thereby halting the voltage step-up operation.

With this configuration, the same effects are thereby obtained as for the third embodiment.

Furthermore, by comparison with the third embodiment, the fourth embodiment disconnects the energy injection line β when there is judged to be a failure, without waiting for an interval of operation continuation that is caused by residual electrical charge, after the power supply is interrupted. That is to say, when failure is judged to occur, injection of electrical energy into the primary winding 3 is halted without waiting for completion of discharging electrical energy from the capacitor 13. Hence, the stability and reliability of the ignition apparatus can be increased.

The output halt switch means 33 may be installed independent of the output halt drive circuit 34, or a cylinder selection means, which selects the ignition coil 2 to be an energy injection destination may be combined with these components.

It would be equally possible to combine a plurality of the above embodiments.

With the above embodiments, various controls are performed based on the absolute value of the capacitor discharge current or the capacitor charge current. However, the invention is not limited to that, and it would be equally possible to execute various types of control based on slope angle (variation angle of detected current) relative to the elapsed time of capacitor charge current flow and capacitor discharge current flow.

With the above embodiments, the primary-side current detection means 24 (current detection resistor) is located at the grounded end of the capacitor 13. However, the location of the primary-side current detection means 24 is not limited to that, and it is only needed to detect the current which flows in the energy injection line β (the current that is supplied to the primary winding 3 from the energy injection circuit 6), etc.

The above embodiments have been described for the case where the ignition apparatus of the present disclosure is applied to a gasoline engine. However, since the present disclosure enables the ignitability of a fuel/air mixture to be increased by means of a continuation spark discharge, the present disclosure would also be applicable to engines which use ethanol fuel, or blended fuel. The present disclosure could of course also be used for increasing the ignitability by means of continuation spark discharge, in an engine which may possibly use low-quality fuel.

The above embodiments have been described for the case where the ignition apparatus of the present disclosure is applied to a lean-burn engine which is capable of running under lean-burn combustion condition, with poor ignitability. This application of the apparatus enables the ignitability to be increased by means of continuation spark discharge. However, the present disclosure improves ignitability by the continuation spark discharge even under combustion conditions different from the lean-burn combustion. Accordingly, the present disclosure could equally be applied to an engine which does not apply lean-burn combustion operation.

Furthermore, the invention could equally be applied to increasing the ignitability in a high-EGR engine (an engine having a high ratio of exhaust gas that is returned to the engine in exhaust gas regeneration operation).

Similarly, the present disclosure could equally be applied to increasing the air/fuel mixture ignitability, by means of continuation spark discharge, in an engine when the engine is operating at a low temperature, and so has low ignitability.

The above embodiments have been described for the case where the ignition apparatus of the present disclosure is applied to a direct-injection type of engine in which fuel is directly injected into the combustion chambers. However, the present disclosure could equally be applied to a port-injection type of engine in which the fuel is injected at the downstream side of the air intake valve (injected into the interior of the air intake port).

The above embodiments have been described for the case where the ignition apparatus of the present disclosure is applied to a type of engine which actively produces rotational flows (tumble flow or swirl flow, etc.) within each engine cylinder, so that the continuation spark discharge of the embodiments serves to prevent quenching of the spark discharge by the rotational flows. However, the present disclosure could equally be applied to a type of engine which does not incorporate rotational flow control means (tumble flow control valve, swirl flow control valve, etc.).

The above embodiments have been described for the case where the ignition apparatus of the present disclosure is applied to a DI type of ignition apparatus. However, the present disclosure could equally be applied, for example, to a single-cylinder engine (e.g., the engine of a two-wheel motor vehicle) in which the ignition coil 2 is installed at a position separate from the spark plug 1.

With the above embodiments, a full transistor type of circuit is used as the main ignition circuit 5. However, the present disclosure is not limited to this. That is, the main ignition circuit 5 only needs to effect the main ignition by control of the current passing condition of the primary winding 3, and thus may be served by an ignition circuit other than a full transistor circuit such as a CDI ignition circuit.

DESCRIPTION OF REFERENCE SIGNS

1 spark plug
2 ignition coil
3 primary winding
4 secondary winding
5 main ignition circuit
6 energy injection circuit
12 step-up circuit
13 capacitor
24 primary-side current detection means
25 first protection means

The invention claimed is:

1. An ignition apparatus for an internal combustion engine, comprising:

a main ignition circuit configured to produce a spark discharge in a spark plug by controlling current flow in a primary winding of an ignition coil; and an energy injection circuit configured to, after a spark discharge has commenced to be generated by operation of the main ignition circuit, supply electrical energy into the primary winding such as to produce a flow of a secondary current through a secondary winding of the ignition coil in an unchanged direction of flow, to thereby continue the spark discharge that is produced by operation of the main ignition circuit, wherein:

the energy injection circuit comprises:

a step-up circuit configured to step up a battery voltage;

a capacitor configured to store electrical energy that has been subjected to voltage step-up by the voltage step-up circuit;

a primary-side current detector configured to detect a capacitor discharge current that is supplied from the capacitor to the primary winding; and a first protection circuit configured to control the electrical energy that is supplied into the primary winding from the capacitor, based on the capacitor discharge current that is detected by the primary-side current detector, to thereby limit a maximum value of the capacitor discharge current detected by the primary-side current detection detector to be less than a specific first control value, wherein:

the first protection circuit is further configured to judge occurrence of failure of the energy injection circuit based upon a capacitor discharge current or a capacitor charge current that is detected by the primary-side current detector; and the ignition apparatus further comprises:

a first switch configured to turn on/off a step-up power source line which applies the battery voltage to the step-up circuit; and a second switch configured to turn on/off an energy injection line which supplies the electrical energy into the primary winding, wherein when a failure is judged to occur, the step-up power source line is disconnected by switching off the first switch, thereby halting the supply of electric power to the step-up circuit or the energy injection line is opened by switching off the second switch, thereby halting the injection of electrical energy into the primary winding.

2. An ignition apparatus for an internal combustion engine, comprising:

a main ignition circuit configured to produce a spark discharge in a spark plug by controlling current flow in a primary winding of an ignition coil; and an energy injection circuit configured to, after a spark discharge has commenced to be generated by operation of the main ignition circuit, supply electrical energy into the primary winding such as to produce a flow of a secondary current through a secondary winding of the ignition coil in an unchanged direction of flow, to thereby continue the spark discharge that is produced by operation of the main ignition circuit, wherein:

the energy injection circuit comprises:

a step-up circuit configured to step up a battery voltage;

a capacitor configured to store electrical energy that has been subjected to voltage step-up by the voltage step-up circuit;

a primary-side current detector configured to detect a capacitor discharge current that is supplied from the capacitor to the primary winding; and a protection circuit configured to halt the injection of electrical energy from the capacitor into the primary winding when the capacitor discharge current detected by the primary-side current detector attains a specific control value, wherein:

the protection circuit is further configured to judge occurrence of failure of the energy injection circuit based upon a capacitor discharge current or a capacitor charge current that is detected by the primary-side current detector; and the ignition apparatus further comprises:

a first switch configured to turn on/off a step-up power source line which applies the battery voltage to the step-up circuit; and a second switch configured to turn on/off an energy injection line which supplies the electrical energy into the primary winding, wherein when a failure is judged to occur, the step-up power source line is disconnected by switching off the first switch, thereby halting the supply of electric power to the step-up circuit or the energy injection line is opened by switching off the second switch, thereby halting the injection of electrical energy into the primary winding.

3. The ignition apparatus for an internal combustion engine as claimed in claim 1, wherein the primary-side current detector is configured to serve as a current detection resistor disposed at a grounded end of the capacitor.

4. The ignition apparatus for an internal combustion engine as claimed in claim 2, wherein the primary-side current detector is configured to serve as a current detection resistor disposed at a grounded end of the capacitor.

5. The ignition apparatus for an internal combustion engine as claimed in claim 1, wherein: the first protection circuit is further configured to judge that there is failure of the energy injection circuit when one of the following conditions, or an combination of a plurality of these conditions, occurs:

the capacitor discharge current detected by the primary-side current detector reaches a predetermined second control value;

the capacitor discharge current reaches the second control value for a predetermined number of times in succession;

the capacitor discharge current reaches the second control value, and continues at that value for a predetermined duration.

6. The ignition apparatus for an internal combustion engine as claimed in claim 1, wherein: the first protection circuit is configured to judge that there is failure of the energy injection circuit when one of the following conditions, or an combination of a plurality of these conditions, occurs:

during voltage step-up operation of the step-up circuit, the capacitor charge current does not reach a predetermined third control value;

the capacitor charge current does not reach the third control value for a predetermined number of times in succession;

the capacitor charge current does not reach the third control value, and continues that condition for a predetermined duration.

7. The ignition apparatus for an internal combustion engine as claimed in claim 1, wherein the ignition apparatus further comprises:

a first drive circuit which changes over the operation first switch to an off state; and a second drive circuit which changes over the second switch to an off state.

8. The ignition apparatus for an internal combustion engine as claimed in claim 2, wherein that the ignition apparatus further comprises:

a first drive circuit which changes over the operation first switch to an off state; and a second drive circuit which changes over the second switch to an off state.

9. The ignition apparatus for an internal combustion engine as claimed in claim 1, wherein that the ignition apparatus further comprises:

an energy injection switch connected in the energy injection line;

wherein the second switch is configured to turn off the energy injection line between the energy injection switch and the primary winding when the failure of the energy injection circuit is detected by the first protection circuit, thereby halting injection of electrical energy into the primary winding.

10. The ignition apparatus for an internal combustion engine as claimed in claim 2, wherein that the ignition apparatus further comprises:

an energy injection switch connected in the energy injection line;

wherein the second switch is configured to turn off the energy injection line between the energy injection switch and the primary winding when the failure of the energy injection circuit is detected by the protection circuit, thereby halting injection of electrical energy into the primary winding.

11. An ignition apparatus for an internal combustion engine, comprising:

a main ignition circuit configured to produce a spark discharge in a spark plug by controlling current flow in a primary winding of an ignition coil; and an energy injection circuit configured to, after a spark discharge has commenced to be generated by operation of the main ignition circuit, supply electrical energy into the primary winding such as to produce a flow of a secondary current through a secondary winding of the ignition coil in an unchanged direction of flow, to thereby continue the spark discharge that is produced by operation of the main ignition circuit, wherein:

the energy injection circuit comprises:

a step-up circuit configured to step up a battery voltage;

a capacitor configured to store electrical energy that has been subjected to voltage step-up by the voltage step-up circuit;

a primary-side current detector configured to detect a capacitor discharge current that is supplied from the capacitor to the primary winding; and a first protection circuit configured to control the electrical energy that is supplied into the primary winding from the capacitor, based on the capacitor discharge current that is detected by the primary-side current detector, to thereby limit a maximum value of the capacitor discharge current detected by the primary-side current detection detector to be less than a specific first control value, wherein:

the first protection circuit is further configured to judge occurrence of failure of the energy injection circuit based upon a capacitor discharge current or a capacitor charge current that is detected by the primary-side current detector;

the ignition apparatus further comprises a first switch configured to turn on/off a step-up power source line which applies the battery voltage to the step-up circuit; and when the failure is judged to occur by first protection circuit, the step-up power source line is disconnected by switching off the first switch, thereby halting the supply of electric power to the step-up circuit.

12. The ignition apparatus for an internal combustion engine as claimed in claim 11, wherein that the ignition apparatus further comprises:

a second switch configured to turn on/off an energy injection line which supplies the electrical energy into the primary winding, wherein the energy injection line is opened by switching off the second switch when the failure is judged to occur by first protection circuit.

13. The ignition apparatus for an internal combustion engine as claimed in claim 12, wherein that the ignition apparatus further comprises:

an energy injection switch connected in the energy injection line;

wherein the second switch is configured to turn on/off the energy injection line between the energy injection switch and the primary winding.

14. The ignition apparatus for an internal combustion engine as claimed in claim 9, wherein the energy injection switch and the second switch are connected in series in the energy injection line.

15. The ignition apparatus for an internal combustion engine as claimed in claim 10, wherein the energy injection switch and the second switch are connected in series in the energy injection line.

16. The ignition apparatus for an internal combustion engine as claimed in claim 13, wherein the energy injection switch and the second switch are connected in series in the energy injection line.

* * * * *